United States Patent [19]

Boyd, Jr. et al.

[11] Patent Number: 5,029,354

[45] Date of Patent: Jul. 9, 1991

[54] KNIFE

[75] Inventors: Francis M. Boyd, Jr., San Francisco, Calif.; Frank M. Boyd, Sr., Austin, Tex.

[73] Assignee: F. Boyd, Ltd., San Francisco, Calif.

[21] Appl. No.: 574,367

[22] Filed: Aug. 24, 1990

[51] Int. Cl.[5] ..... B25F 1/04

[52] U.S. Cl. ..... 7/118; 7/165; 7/158; 7/168; 30/161

[58] Field of Search ..... 7/118, 168, 158, 165; 30/151, 155, 160, 161

[56] References Cited

U.S. PATENT DOCUMENTS

| | | | |
|---|---|---|---|
| 300,858 | 6/1884 | Feicker, Jr. | 7/168 |
| 1,036,664 | 8/1912 | Marble | 7/168 |
| 1,039,260 | 9/1912 | Cooper | 7/118 |

FOREIGN PATENT DOCUMENTS

| | | | |
|---|---|---|---|
| 52170 | 6/1890 | Fed. Rep. of Germany | 30/160 |
| 24428 | of 1910 | United Kingdom | 30/155 |

*Primary Examiner*—Roscoe V. Parker
*Attorney, Agent, or Firm*—Frank L. Zugelter

[57] ABSTRACT

A knife (20) having its member (21) comprising blade (22) and tang (23) locked to its side rails (24, 25) whichever way blade (22) or tang (23) seat in the knife (20). Side rails (24, 25) include opposing or non-corresponding edges (43, 44) which includes bayonet slots (41, 42) respectively. One pin (55) on blade (22) cooperatively engages bayonet slot (41) when the blade (22) is disposed in a pocket (40) between the side rails (24, 25), and one pin (54) on tang (23) cooperatively engages bayonet slot (42) when the tang (23) is disposed in pocket (40). Urging means (32) such as rubber bands (34, 35) urge the pins (55, 54) in their corresponding bayonet slots (41, 42) to stay therein and means such as rounds (63, 64) on side rails (24, 25) overcome such urging so that member (21) shifts into a pivoting position to unlock either blade (21) or tang (22) for pivoting either one out of pocket (40).

10 Claims, 3 Drawing Sheets

26
81
27
7
61
60
27
33
31
70
25
23
40
20
24
54
21
7

20
27
33
24
27
31
55
70
40
25
22
60
61
57
21
62

27
77
27
77
26
38
34
36
37
24
32
36
73
39
43
75
78
20
78
45
47
29
66
62
72
63
41
57
55
70
60
61
28
56
22
78
73
21
25
65
75
23
42
48
54
78
44
71
30
35
38
64
46
36
74
37
32
36
77
26
77
76
27
79
27

KNIFE

TECHNICAL FIELD

This invention relates to a cutlery product, and in particular, relates to a pocket knife whose blade is locked in both open and closed modes by a unique arrangement of its elements.

BACKGROUND

This is an improvement on the invention disclosed and claimed in co-pending U.S. patent application Ser. No. 07/234,608, filed Aug. 22, 1988 and now U.S. Pat. No. 4,961,239.

In the aforementioned co-pending application, three (3) pins project from both faces of a member comprising the knife's blade and tang, for cooperating with bayonet slots in side rails and the combination of camming surfaces and slots at the one ends of the side rails. The first and third of such pins co-operate with their corresponding bayonet slots in both side rails. The side rails sheath either the blade or the knife's tang. The second or middle pin rides on the corresponding ends of both side rails and in which action cams the member in its pivotal relationship to the side rails so as to place the knife's blade and tang in their respective open and closed positions for either pivoted position of such member. The middle pin itself is deposited into either one of two slots formed in the corresponding ends of both side rails as the member is locked in either position. Biasing means, such as coiled springs, mounted to the member retain the first and third pins and the second pin in the bayonet slots and end slots, respectively.

DISCLOSURE OF THE INVENTION

In the present invention, the middle pin is omitted, the first pin projects only from one face in the blade (and not from both of its faces) for cooperation with a single bayonet slot which is carved into one side rail along only one of its longitudinal edges, the third pin projects only from the opposing face in the tang for cooperation with a single bayonet slot which is carved into the other side rail along only a longitudinal edge which does not correspond to the first-mentioned edge in the first-mentioned side rail. A cam in the form of a small button is fixedly mounted on the back edge (vis-a-vis a cutting edge) of the member for riding on the rounded corresponding ends of and onto corresponding longitudinal edges of the side rails, at the one end of the knife at which relative pivoting between member and side rails occurs. The camming action arises out of biasing or urging means, such as coiled springs or rubber bands mounted to the member, which throws or biases the member in a direction towards the other end of the knife.

An object of this invention is to provide a novel knife particularly as to its mechanism and manner of locking its blade and tang in open and closed positions.

Another object of this invention is to simplify the fabrication steps in making a dependable knife, whether for pocket or other uses.

Another object of this invention is to provide safety in the operation thereof.

A further object of this invention is to provide narrowness, if desired, in the knife, to thereby produce a variety of models.

A further object of this invention is to mass produce a single fabricated side rail that can be utilized for either of the two locations for side rails in a knife.

These and other objects and advantages will become more apparent upon a full and complete reading of the following description, appended claims thereto, and the accompanying drawing comprising three (3) sheets of eleven (11) FIGURES.

BEST MODE FOR CARRYING OUT THE INVENTION

Figure 1:
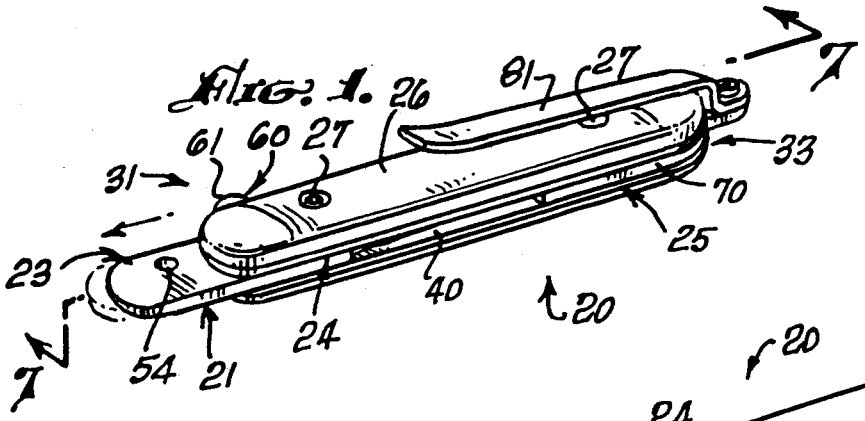
FIG. 1 is a perspective view of a knife having its blade closed and in locked mode and which embodies the invention.

Referring now to the drawing wherein reference characters correspond to like numerals hereinafter, the invention is embodied in a knife 20, FIGS. 1-3, comprising a member 21 which forms a cutting blade 22 and a tang 23, member 21 being pivotally mounted to a pair of side rails 24, 25 onto each of which a corresponding one of a pair of handle segments 26 is suitably securely mounted by means of screws 27. Member 21 includes an aperture 28 to opposite directions of which the paths of blade and tang are directed and in which a pivot axis for member 21 is located. The side rails 24, 25 include aligned formations of longitudinally-extending slots 29, 30, respectively, adjacent the one end 31 of knife 20, and in which the aforementioned pivot axis also is located. Member 21 is capable of shifting its position within slots 29, 30 to such pivot axis between it and rails 24, 25 during operation of the invention, more fully described hereinafter.

Means 32 are provided for urging member 21 towards the other end 33 of knife 20. Means 32 comprises urging mechanisms, such as coiled springs (not shown) or a pair of stretched rubber bands 34, 35, each of which being disposed adjacent to and along its corresponding side rail 24, 25. Each band 34, 35 is mounted about or to a pair of spaced annular grooves 36 formed in a cone head bushing 37 disposed adjacent knife end 31 and in a capstand screw 38 disposed adjacent knife end 33. Both bushings 37 at knife end 31 are threadedly secured on opposite ends of a small shaft 39 which slip fits through aperture 28 of member 21 and extends through slots 29, 30 of side rails 24, 25. The two (2) capstand screws 38 at knife end 33 are threaded to corresponding holes in their respective side rails 24, 25 without either extending into a pocket 40 formed by the spacing between such side rails for disposition of member 21.

Figure 4:
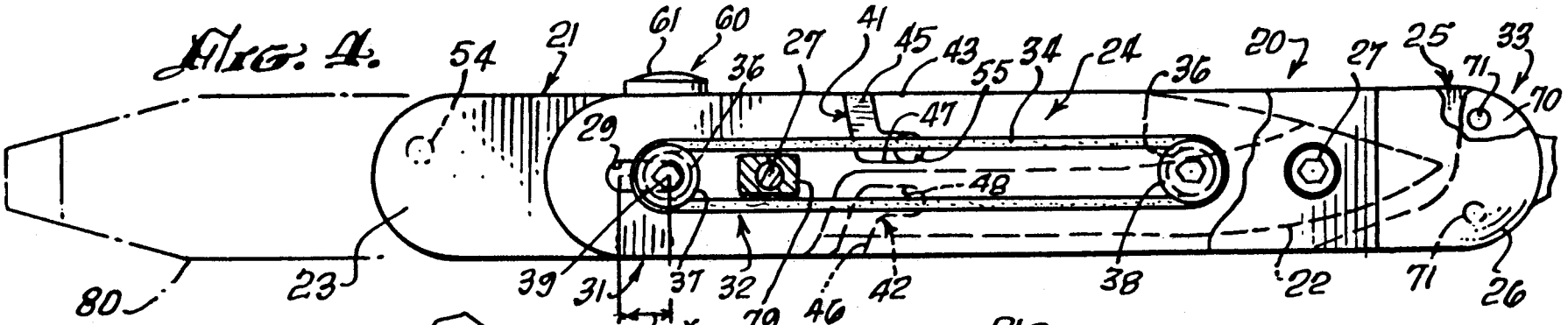
FIG. 4 is a side view, with cutaway portions, of the knife embodiment of FIGS. 1 and 2.

Member 21 and shaft 39 are shiftable to the aforementioned pivoting position by a sliding movement in slots 29, 30, within the latter's longitudinal dimensional limits, as seen at X, FIG. 4. Thus, a bias of member 21 results in an urging towards the knife end 33 by reason of tensed bands 34, 35 pulling it in that direction. Rubber bands 34, 35 always remain taut or stretched in their operative positions on annular grooves 36 when not in a further stretched condition during pivotal operation of the knife.

Figure 3:
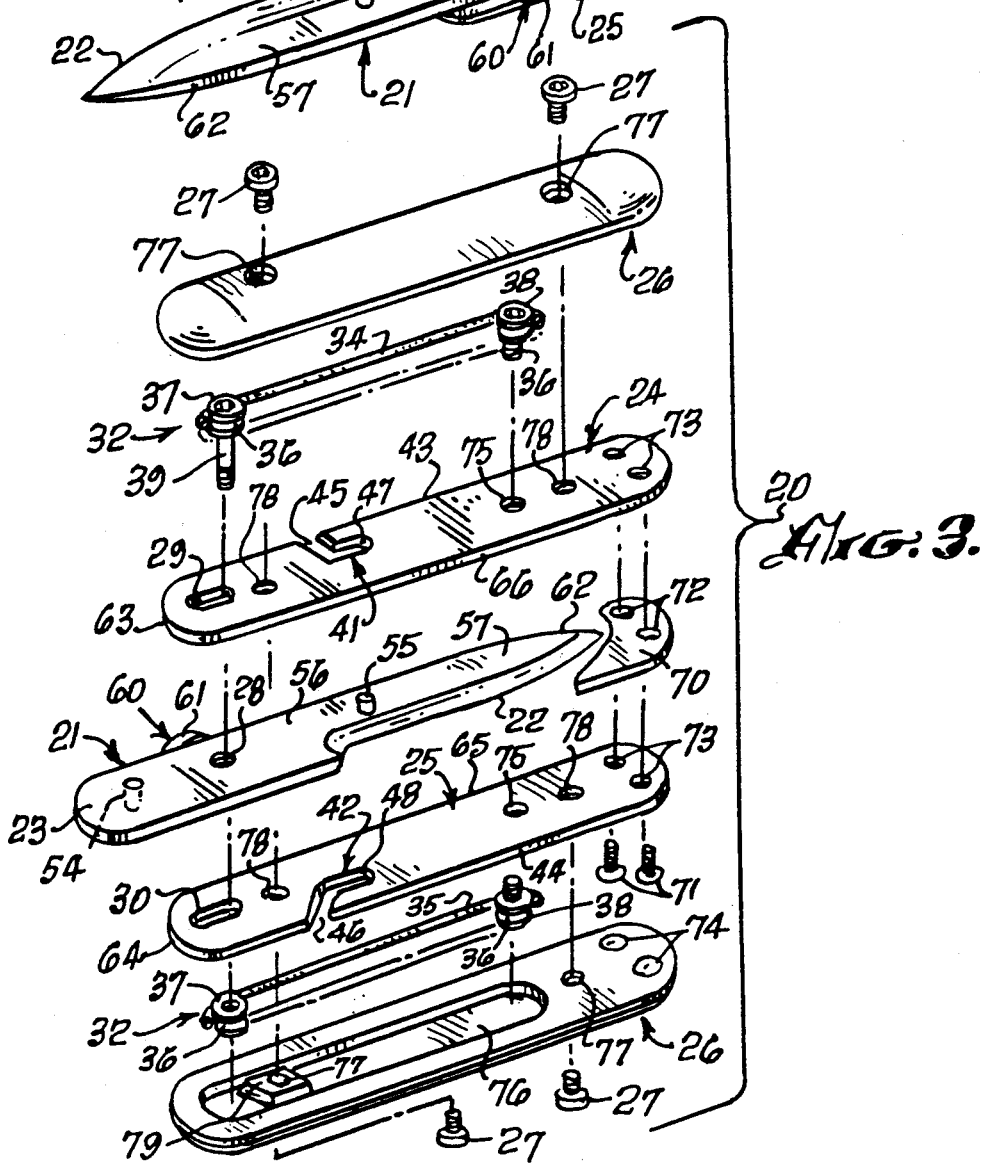
FIG. 3 is an exploded perspective view of the knife of FIG. 1.

Bayonet slots 41, 42 are formed in non-corresponding longitudinal edges 43, 44 of side rails 24, 25, respectively, FIG. 3. Their respective catches 45, 46 are in alignment with one another in the assembly of knife 20, however, they are located on the opposite or non-corresponding longitudinal edges 43, 44 to each other. The direction of both slots corresponding seats 47, 48 is towards end 33. It is to be noted here that the fabrication of the side rails 24, 25 provides for longitudinal edges 43, 44 to be corresponding to one another during such fabrication, particularly as to forming the bayonet slots 41, 42. However, in assembly of knife 20, one of these rails is "flipped" about its longitudinal axis, so that in such assembly, bayonet slot 41 is shown to be carved from edge 43, FIG. 3, in side rail 24 while bayonet slot 42 is shown to be carved from an edge 44, FIG. 3, in side rail 25. It now should be apparent that in fabrication of each of these side rails 24, 25, fabrication is the same for both side rails, done so in mass production procedures, and then adapted for use as either side rail 24 or side rail 25. Each of a pair of pins 54, 55 is securely mounted to member 21, projecting from its corresponding face 56, 57, each of such pins being located at a distance from the pivot hole 28 in member 21 so that it can enter its corresponding catch 45, 46 during pivotal motion between rails 24, 25 and member 21 in operation of the invention. Pin 54 projects from face 56 within the areal dimensions of tang 23 so that it can ingress to or egress from its corresponding catch 46 during pivotal motion between rails 24, 25 and member 21 in such operation. Pin 55 projects from opposing face 57 within the areal dimensions of blade 22 so that it can ingress to or egress from its corresponding catch 45 during pivotal motion between rails 24, 25 and member 21 in such operation. Once each of these pins 54, 55 engages its corresponding catch 45, 46, to move in its catch to a point where it can slide to its corresponding seat 47, 48, the biasing effect of the urging mechanisms or bands 34, 35 brings home such pin to the base of its seat, thereby locking member 21 to the side rails 24, 25.

With blade 22 closed and in locked mode, i.e., it is disposed in pocket 40, pin 55 is disposed at the base of seat 47 of bayonet slot 41, while pin 54 disposed on tang 23 can be visibly observed. When blade 22 is open and in locked mode, i.e., tang 23 is disposed in pocket 40 and blade 22 being visible, the tang's pin 54 is disposed at the base of seat 48 of bayonet slot 42.

As biasing means 32 trys to maintain each pin 54, 55 in its corresponding bayonet slot 41, 42 during pivotal motion between member 21 and side rails 24, 25, a means 60 to overcome the action of biasing means 32 is provided. Means 60 comprises a button 61 securely mounted (as by welding) on the back or non-cutting edge 62 of member 21 for riding on rounds 63, 64 provided on the ends of side rails 24, 25, respectively, at the one knife's end 31, and onto the edges 43, 65 of side rails 24, 25, respectively, on the one hand and onto the edges 66, 44 of side rails 24, 25, respectively, on the other hand. Thus, as button 61 transfers or slides from rounds 63, 64 onto edges 43, 65 of rails 24, 25, respectively, pin 55 on blade face 56 enters catch 45 in rail 24. And as button 61 transfers or slides from rounds 63, 64 onto edges 66, 44 of rails 24, 25, respectively, pin 54 on tang face 56 enters catch 46 in rail 25. Thereafter, biasing means 32 provides the action by which each pin 55, 54 seeks the base of its corresponding seat 47, 48 in its corresponding bayonet slot 41, 42 and thereby lock member 21 to its side rails, in either mode, i.e., with blade open and tang in pocket 40 or tang open with blade in pocket 40.

Figure 5:
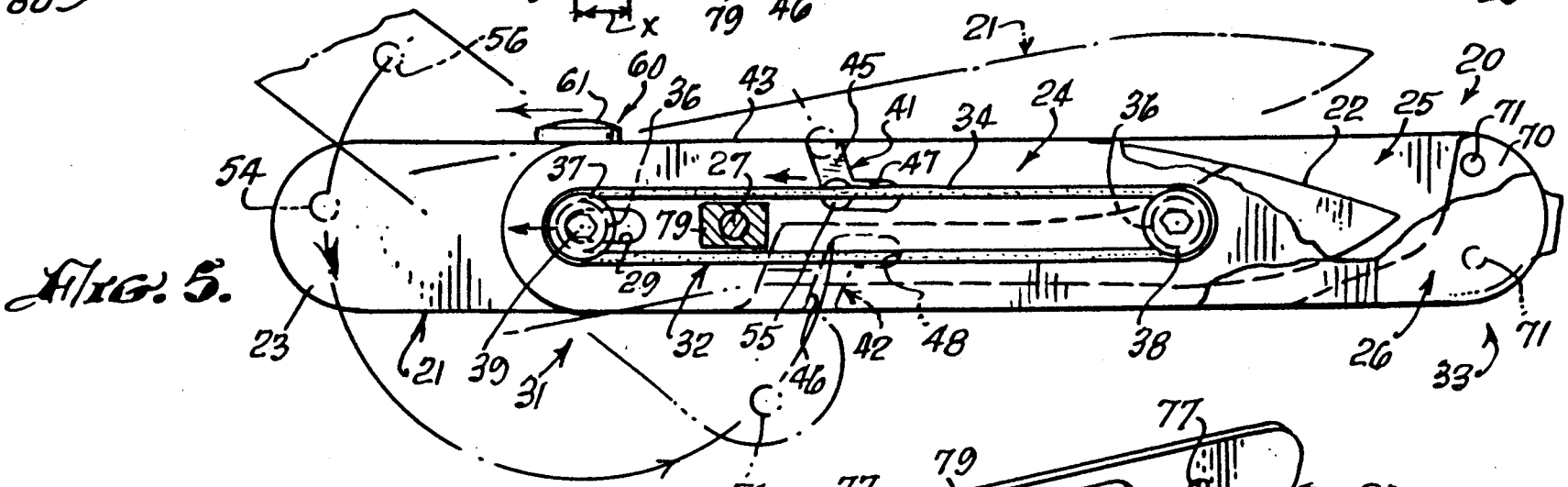
FIG. 5 is a view taken on the same side of the knife illustrated in FIG. 4, however, a sliding movement for the knife's member comprising blade and tang is disclosed, by it being shown in a different position than its position shown in FIG. 4, along with corresponding changes of positions for other elements.

The essence of operation of the invention, FIGS. 4, 5, is to pivot member 21 and side rails 24, 25 relative to one another in order to lock themselves in either of the aforementioned modes. To accomplish this locking objective starting with the knife's blade 22 closed and in locked mode, tang 23 is grasped and pulled in a direction away from end 33, so that the blade's pin 55 in seat 47 of its bayonet slot 41 is shifted forwardly to align itself with that slot's catch 45, this action being against the biasing or urging force of means 32 to maintain pin 55 at the base of its seat 47. Member 21 thus is now pivotable, and as it pivots, pin 55 egresses from its catch 45. As the relative pivoting motion continues, stabilized by button 61 riding on or engaging rounded ends 63, 64 of rails 24, 25, respectively, the tang's pin 54 enters and engages its catch 46 of bayonet slot 42. When pin 54 aligns itself with seat 48 of bayonet slot 42, the pull of biasing or urging means 32 causes it to snap to the base of seat 48, with blade 21 and its pin 55 now open. To reverse such operation, i.e., tang 23 rotates out of pocket 40, and is replaced with blade 22 in pocket 40, blade 22 is pulled in a direction away from knife's end 33 to thereby unseat pin 54 in bayonet slot 42, aligning it with that slot's catch 46, this action being against the biasing or urging force of means 32 to maintain pin 54 at the base of its seat 48. Member 21 now is pivotable again, and as it pivots, pin 54 egresses from catch 46. As the relative pivoting motion continues, stabilized by button 61 riding on rounded ends 63, 64 of rails 24, 25, respectively, the blade's pin 55 enters its catch 45 of bayonet slot 42. When pin 55 aligns itself with seat 47, biasing or urging means 32 causes it to snap to the base of seat 47, with blade 21 now closed and tang 23 and its pin 54 open.

Figure 6:
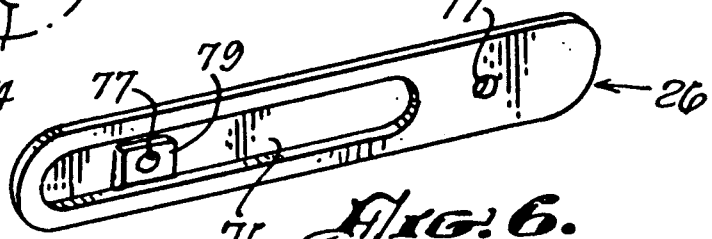
FIG. 6 is a perspective view of the interior of the handle segment also seen as a component illustrated at the top of FIG. 3.
Figure 7:
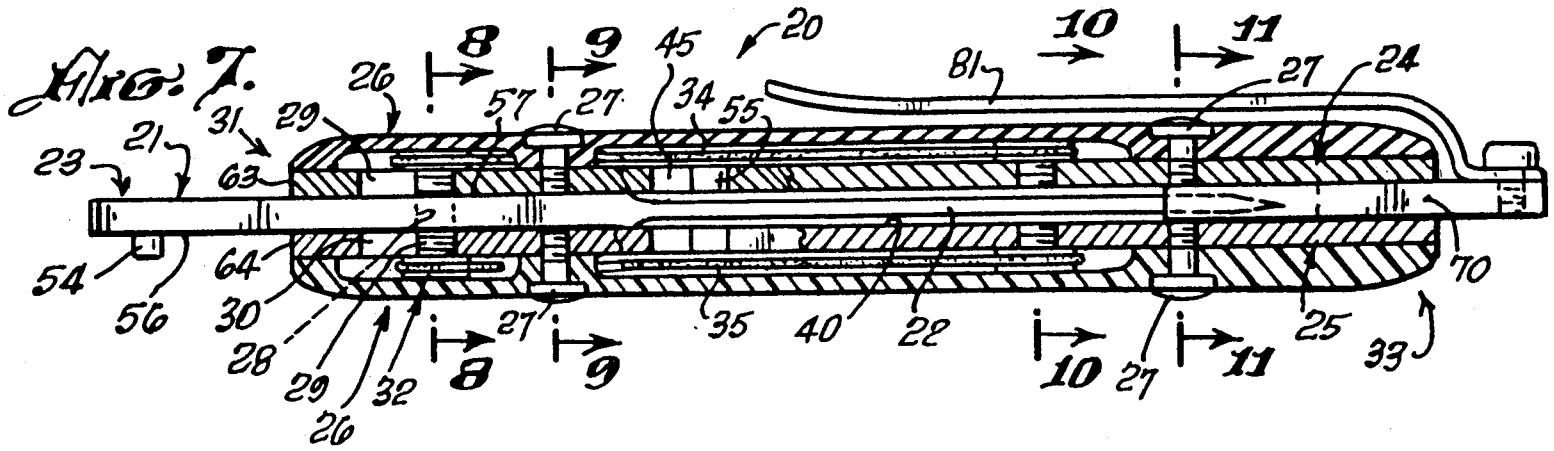
FIG. 7 is a view taken on line 7—7 of FIG. 1.
Figure 8:
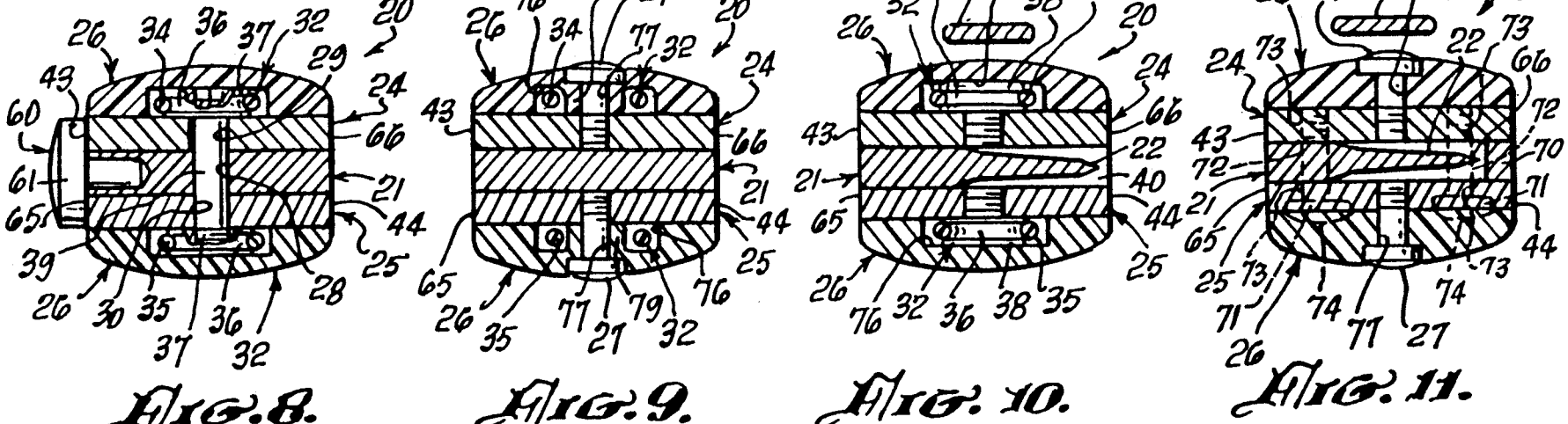
FIGS. 8, 9, 10 and 11 are views taken respectively on lines 8—8, 9—9, 10—10, and 11—11 of FIG. 7.
Figure 9:
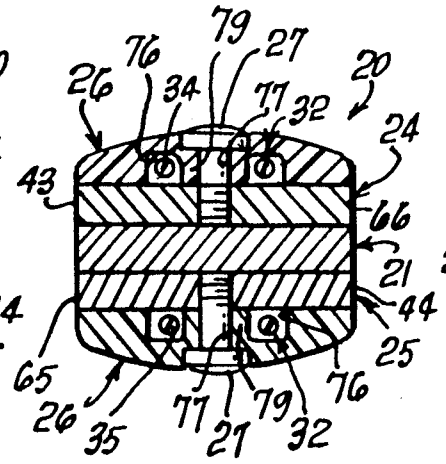
Figure 10:
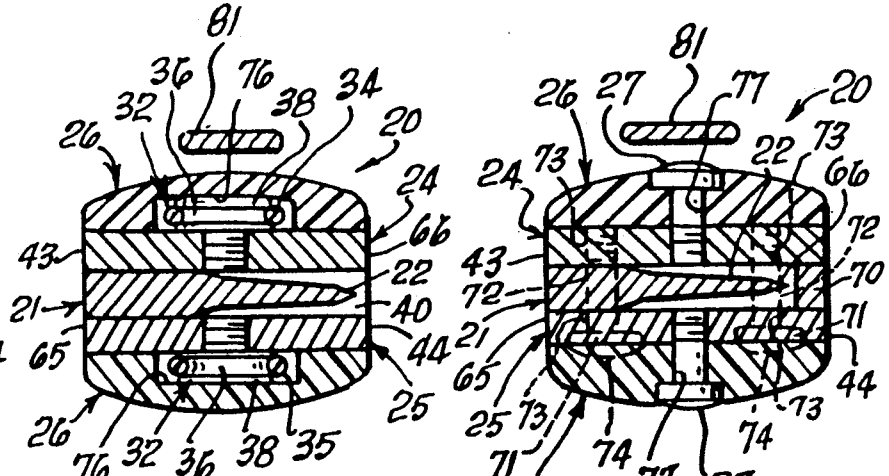
Figure 11:
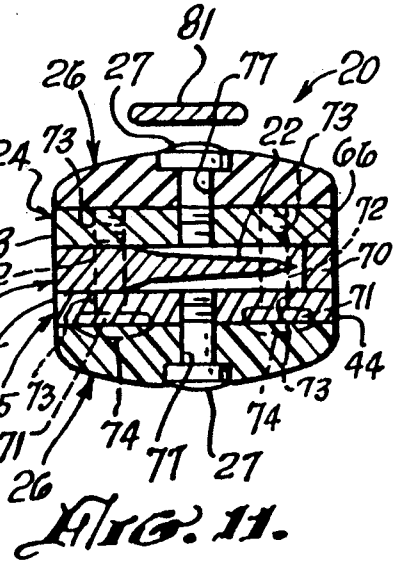

In assembly, FIG. 3, pins 54, 55 are press fit to holes formed in blade and tang. A spacer 70 (to maintain pocket 40 between rails 24, 25) is secured at knife's end 33 to side rails 24, 25 by suitable screws 71 threaded through tapped holes 72 of the spacer and tapped holes 73 in side rails 24, 25. Cutout cavities 74 are provided in the one handle segment 26, FIG. 3, to accommodate the heads of screws 71, however, such cavities are not required in the other handle segment illustrated in FIG. 6. Member 21 is positioned between side rails 24, 25, with pin 55 inserted into the catch 45 and seat 47 of bayonet slot 41. Shaft 39 with one annular grooved bushing 37 secured thereto is inserted through longitudinal slots 29, 30 of rails 24, 25 and aperture 28 in member 21. The other annular grooved bushing 37 then is mounted and secured to shaft 39. Capstand screws 36 are threaded to corresponding tapped holes 73 in side rails 24, 25. Bands 34, 35 are mounted to their corresponding pairs of annular grooves 36 on elements 37, 38. Handle segments 26, with recessed portions 76 (visible in FIG. 3 and FIG. 6)

for accommodating bushings and capstand screws, are mounted to or about their corresponding side rails 24, 25, by means of Allen screws 27 extending through handle segment holes 77 and thence being threaded to tapped holes 78 in the side rails. Some body formation 79 in each segment 26 remains about holes 77 located in recessed portions 76 in the one end of the handles so that as Allen screws 27 thread into tapped holes 74 at such one end of side rails 24, 25, the thinner portion of each segment 26 resulting from the formation of its recessed portion 76 does not give under the pressure of such Allen screws. Such body formations 79 are configured so as not to disturb the lengths of rubber bands 34, 35 which lie within the recessed portions 76.

Suitable materials are readily available for the above described elements; stainless steel for blade 21, side rails 23, 24 and spacer 70; wooden or plastic materials for handle segments 26; and metal for the screw and annular grooved elements. Rubber bands 34, 35 are of ordinary and proper size and strength to function as the urging or biasing mechanisms.

Various modifications and changes may be made without departing from the spirit or scope of the invention. Coiled metal springs can be substituted for bands 34, 35. Other described features may be suitably combined to facilitate mass production or manufacture, an example of which being the combining of screws 26 with bushings 37 and capstands 38. Catches 45, 46 need not be aligned with one another when their corresponding cooperating pins 55, 54 are mounted at different points on blade and tang than as illustrated. Capstand screws 38 could be modified to integrate the threaded holes 75 in side rails 24, 25, and thus simplify the manufacture of rails 24, 25. A tool, other than or like blade 22, such as a screw driver 80 shown in phantom in FIG. 4, may be integrated into member 21. A clip member 81, FIG. 1, may be attached at the knife's end 33 to spacer 70, if desired.

INDUSTRIAL APPLICABILITY

This invention is very useful as a pocket knife, although the locking feature is readily adaptable for other purposes such as multi-purpose tools having parts replacing blade and tang that are adpated for mounting tools thereon.

We claim:

1. In a knife having a member comprising a blade and a tang and with a back edge and first and second faces on the member and first and second side rails forming a pocket for the blade or the tang and including rounds at one end of the knife, each of said first and second side rails having a longitudinal edge not corresponding to a longitudinal edge in the other of said side rails, and means for urging either blade or tang when in the pocket towards the other end of the knife, the improvement comprising no more than one pin mounted on said blade, said one pin disposed on the first of said faces, no more than one bayonet slot formed in the first of said side rails, said one bayonet slot disposed in the longitudinal edge in the first of said side rails for cooperative engagement with said one pin, no more than a second one pin mounted on said tang, said second one pin disposed on the second of said faces, no more than a second one bayonet slot formed in the second said side rails, said second one bayonet slot disposed in the longitudinal edge in the second of said side rails for cooperative engagement with said second one pin, the effect of said urging means being to lock said member and side rails together, said member shiftable against the action of said urging means to position it at a pivot axis for it and said side rails whereby blade or tang pivots in or out of the pocket, and means for overcoming the action of said urging means mounted on the back edge of said member, said overcoming means cooperatively engaging said rounds to negate such action of said urging means as the member is at its pivot axis and the blade or tang pivots in or out of the pocket.

2. In the knife of claim 1, said overcoming means comprising a button.

3. In the knife of claim 2, said urging means comprising a pair of rubber bands each mounted about a pair of annular grooves included in a bushing and capstand screw spacedly securely mounted to its corresponding one of said first and second side rails, a shaft connecting together each such bushing to the other through a slot provided in each of said first and second side rails and through an aperture in the member, said shaft including such pivot axis.

4. In the knife of claim 1, said urging means comprising a pair of rubber bands each mounted about a pair of annular grooves included in a bushing and capstand screw spacedly securely mounted to its corresponding one of said first and second side rails, a shaft connecting together each such bushing with the other through a slot provided in each of said first and second side rails and through an aperture in the member, said shaft including such pivot axis.

5. A locking mechanism for a tool comprising a member having first and second parts adapted for mounting a tool thereon and having first and second faces on each of said parts, first and second rails forming a pocket for either of said first and second parts and including rounds at one end of the mechanism, each of said first and second rails having a longitudinal edge not corresponding to a longitudinal edge in the other of said rails, means for urging either of said parts when in the pocket towards the other end of the knife, no more than one pin mounted on the first of said faces on the first of said parts, no more than one bayonet slot formed in the first of said rails, said one bayonet slot disposed in the longitudinal edge in the first of said rails for cooperative engagement with said one pin, no more than a second one pin mounted on the second of said parts, said second one pin disposed on the second of said faces on the second of said parts, no more than a second one bayonet slot formed in the second of said rails, said second one bayonet slot disposed in the longitudinal edge in the second of said rails for cooperative engagement with said second one pin, the effect of said urging means being to lock said member and rails together, said member shiftable against the action of said urging means to position it at a pivot axis for it and said rails whereby it pivots about the pocket, and means for overcoming the action of said urging means mounted on said member, said overcoming means cooperatively engaging said rounds to negate such action of said urging means as the member is at its pivot axis.

6. The locking mechanism of claim 5 wherein said member includes a member edge, said overcoming means mounted on said member edge.

7. The locking mechanism of claim 6 wherein said overcoming means is a button.

8. The locking mechanism of claim 5 wherein said urging means comprises a pair of rubber bands each mounted about a pair of annular grooves included in a bushing and capstand screw spacedly securely mounted to its corresponding one of said rails, a shaft connecting together each such bushing with the other through a slot provided in each of said rails and through an aperture in the member, said shaft including such pivot axis.

9. The locking mechanism of claim 6 wherein said urging means comprises a pair of rubber bands each mounted about a pair of annular grooves included in a bushing and capstand screw spacedly securely mounted to its corresponding one of said rails, a shaft connecting together each such bushing with the other through a slot provided in each of said rails and through an aperture in the member, said shaft including such pivot axis.

10. The locking mechanism of claim 7 wherein said urging means comprises a pair of rubber bands each mounted about a pair of annular grooves included in a bushing and capstand screw spacedly securely mounted to its corresponding one of said rails, a shaft connecting together each such bushing with the other through a slot provided in each of said rails and through an aperture in the member, said shaft including such pivot axis.

* * * * *

UNITED STATES PATENT AND TRADEMARK OFFICE

CERTIFICATE OF CORRECTION

PATENT NO. : 5,029,354

DATED : July 9, 1991

INVENTOR(S) : Boyd, Francis M. Jr. etal

It is certified that error appears in the above-identified patent and that said Letters Patent is hereby corrected as shown below:

In column 1, before the period (.) read -- granted October 9, 1990 --.

In column 2, line 54, after "32" read--, FIG.3,--.

In column 2, line 67, after "holes" read -- 75--.

Figure 2:
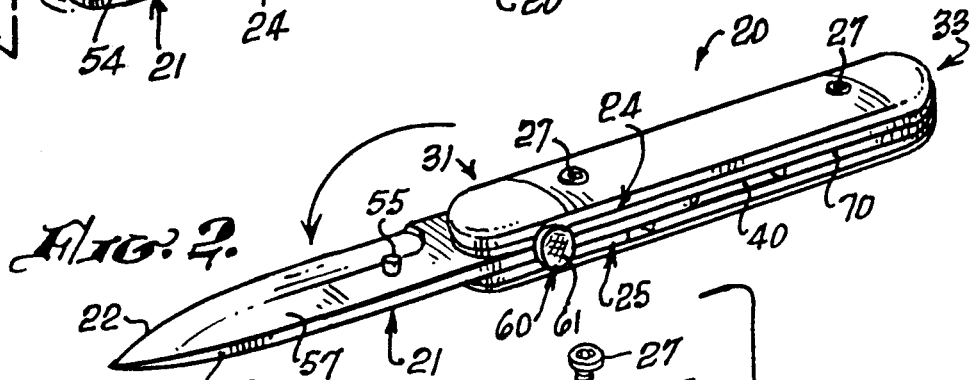
FIG. 2 is a perspective view of such knife having its blade open and in locked mode.

In column 3, line 1, after "40" read--, FIGS. 1,2,--.

In column 3, line 33, read the sentence beginning on this line as a new paragraph.

In column 3, line 37, read "the" after --during--.

In column 3, line 61, read "the" after --during--.

In column 4, line 65, read "73" as -- 75 --.

UNITED STATES PATENT AND TRADEMARK OFFICE

CERTIFICATE OF CORRECTION

PATENT NO. : 5,029,354

DATED : July 9, 1991

INVENTOR(S) : Boyd, Francis M. Jr. et al

It is certified that error appears in the above-identified patent and that said Letters Patent is hereby corrected as shown below:

In column 5, line 8, read "74" as -- 78 --.

In column 5, line 27, read "26" as -- 27 --.

In column 5, line 67, after "second" (first occurrence) read -- of --.

Signed and Sealed this

Fourth Day of May, 1993

Michael K. Kirk

MICHAEL K. KIRK

*Acting Commissioner of Patents and Trademarks*

*Attest:*

*Attesting Officer*